US008065815B2

(12) United States Patent
Christy et al.

(10) Patent No.: US 8,065,815 B2
(45) **Date of Patent: *Nov. 29, 2011**

(54) APPARATUS, METHOD AND SYSTEM FOR TREATING SEWAGE SLUDGE

(75) Inventors: Richard W Christy, Eagleville, PA (US); Robert Van Bramer, Sanatoga, PA (US); Michael Quici, Ambler, PA (US)

(73) Assignee: RDP Technologies, Inc., Norristown, PA (US)

( * ) Notice: Subject to any disclaimer, the term of this patent is extended or adjusted under 35 U.S.C. 154(b) by 1082 days.

This patent is subject to a terminal disclaimer.

(21) Appl. No.: 11/867,951

(22) Filed: Oct. 5, 2007

(65) Prior Publication Data

US 2008/0083675 A1 Apr. 10, 2008

Related U.S. Application Data

(63) Continuation-in-part of application No. 11/539,903, filed on Oct. 10, 2006, now Pat. No. 7,669,348.

(51) Int. Cl.
*F26B 11/00* (2006.01)

(52) U.S. Cl. ..... 34/381; 34/413; 34/497; 210/739; 210/766

(58) Field of Classification Search ..... 34/381, 34/361, 413, 497, 499, 502, 509, 90; 210/739, 210/766

See application file for complete search history.

(56) References Cited

U.S. PATENT DOCUMENTS

| | | | | | |
|---|---|---|---|---|---|
| 1,421,283 | A | * | 6/1922 | Meakin | 99/348 |
| 1,994,343 | A | * | 3/1935 | Graves | 99/471 |
| 2,068,181 | A | * | 1/1937 | Hurxthal | 264/144 |
| 2,267,894 | A | * | 12/1941 | Booth | 19/90 |
| 2,297,195 | A | * | 9/1942 | Behringer | 210/603 |
| 2,638,687 | A | * | 5/1953 | Vincent | 34/136 |
| 2,718,711 | A | * | 9/1955 | Clark | 34/75 |
| 2,723,954 | A | * | 11/1955 | Young | 34/347 |
| 2,825,980 | A | * | 3/1958 | Herrick et al. | 34/131 |
| 2,868,004 | A | * | 1/1959 | Runde | 68/12.15 |
| 2,984,015 | A | * | 5/1961 | Montgomery | 34/60 |
| 3,060,593 | A | * | 10/1962 | Flora et al. | 34/601 |
| 3,088,221 | A | * | 5/1963 | Pansing et al. | 34/527 |
| 3,203,679 | A | * | 8/1965 | Williams et al. | 432/44 |
| 3,400,465 | A | * | 9/1968 | Von Stroh | 34/443 |
| 3,793,841 | A | * | 2/1974 | Dozsa | 405/263 |
| 3,854,219 | A | * | 12/1974 | Staats | 34/265 |
| 3,922,798 | A | * | 12/1975 | McMillan | 34/73 |

(Continued)

FOREIGN PATENT DOCUMENTS

EP 357590 A1 * 3/1990

(Continued)

*Primary Examiner* — Stephen M. Gravini

(74) *Attorney, Agent, or Firm* — Paul & Paul

(57) ABSTRACT

An apparatus, method and system is provided for treating sewage sludge by heating the same in a container to drive off pathogens and/or pasteurize the sewage sludge while the material is tumbled in the container, and with moisture gases being evaporated therefrom and drawn off from the container. After treatment the treated sludge is discharged from the container. There is provided at least one weight-responsive member on which the container is mounted, and a control is provided connected to the one or more weight-responsive member whereby the solids content of the treated material can be determined by measuring the difference in weight of material in the container, before and after moisture is drawn off from the material and prior to its discharge from the drum. The control is preferably effected by means of a computer.

15 Claims, 6 Drawing Sheets

U.S. PATENT DOCUMENTS 3,960,718 A * 6/1976 Lebo ..... 210/758
3,971,639 A * 7/1976 Matthews ..... 48/202
4,028,240 A * 6/1977 Manchak, Jr. ..... 588/252
4,043,909 A * 8/1977 Endo et al. ..... 210/738
4,064,744 A 12/1977 Kistler
4,079,003 A * 3/1978 Manchak ..... 588/313
4,093,505 A * 6/1978 Tsuruta et al. ..... 159/9.2
4,166,997 A 9/1979 Kistler
4,190,372 A * 2/1980 Takagi et al. ..... 366/141
4,204,339 A * 5/1980 Muller ..... 34/75
4,265,700 A * 5/1981 Billgren et al. ..... 159/47.1
4,268,247 A * 5/1981 Freze ..... 432/21
4,268,409 A * 5/1981 Ga et al. ..... 588/20
4,270,279 A * 6/1981 Roediger ..... 34/338
4,295,972 A * 10/1981 Kamei ..... 210/710
4,306,978 A * 12/1981 Wurtz ..... 210/750
4,369,111 A * 1/1983 Roediger ..... 210/199
4,378,886 A * 4/1983 Roediger ..... 209/606
4,443,109 A * 4/1984 Watts ..... 366/134
4,454,770 A 6/1984 Kistler
4,460,470 A * 7/1984 Reimann ..... 210/605
4,474,479 A * 10/1984 Redelman ..... 366/300
4,478,518 A * 10/1984 Tomyn ..... 366/156.2
4,514,307 A * 4/1985 Chestnut et al. ..... 588/315
4,541,986 A * 9/1985 Schwab et al. ..... 422/5
4,574,744 A * 3/1986 Lorenz et al. ..... 122/7 R
4,597,872 A * 7/1986 Andersson et al. ..... 210/605
4,614,587 A * 9/1986 Andersson et al. ..... 210/603
4,621,438 A * 11/1986 Lanciaux ..... 34/77
4,632,759 A * 12/1986 Andersson et al. ..... 210/603
4,659,471 A * 4/1987 Molin et al. ..... 210/603
4,659,472 A * 4/1987 Nordlund et al. ..... 210/609
4,668,344 A * 5/1987 Lorenz et al. ..... 201/39
4,710,032 A * 12/1987 Nordlund ..... 366/156.1
4,711,041 A 12/1987 Ullum
4,712,312 A 12/1987 Christodoulou
4,760,650 A * 8/1988 Theliander et al. ..... 34/513
4,771,156 A * 9/1988 Strattan et al. ..... 219/757
4,781,842 A * 11/1988 Nicholson ..... 405/129.25
4,789,477 A * 12/1988 Nordlund ..... 210/520
4,824,257 A 4/1989 List et al.
4,852,269 A * 8/1989 Glorioso ..... 34/376
4,891,892 A * 1/1990 Narang ..... 34/86
4,902,431 A * 2/1990 Nicholson et al. ..... 405/129.27
4,981,600 A * 1/1991 Tobler et al. ..... 210/739
4,982,514 A 1/1991 Ullum
5,013,458 A 5/1991 Christy, Sr. et al.
5,083,506 A * 1/1992 Horn et al. ..... 99/348
5,186,840 A 2/1993 Christy, Sr. et al.
5,193,292 A * 3/1993 Hart et al. ..... 34/491
5,197,205 A 3/1993 Spada et al.
5,229,011 A 7/1993 Christy, Sr. et al.
5,230,167 A * 7/1993 Lahoda et al. ..... 34/75
5,251,432 A * 10/1993 Bruckner et al. ..... 60/772
5,313,022 A 5/1994 Piroozmandi et al.
5,341,580 A * 8/1994 Teal ..... 34/446
5,345,755 A * 9/1994 Bruckner et al. ..... 60/39.12
5,361,514 A * 11/1994 Lahoda et al. ..... 34/391
5,386,685 A * 2/1995 Frutschi ..... 60/783
5,396,715 A * 3/1995 Smith ..... 34/261
5,405,536 A 4/1995 Christy
5,433,844 A 7/1995 Christy
5,554,279 A 9/1996 Christy
5,560,124 A * 10/1996 Hart et al. ..... 34/493
5,606,804 A * 3/1997 Smith et al. ..... 34/261
5,651,192 A * 7/1997 Horwitz ..... 34/529
5,670,024 A * 9/1997 Baltzer et al. ..... 201/25
5,681,481 A 10/1997 Christy et al.
5,746,983 A 5/1998 Stephansen
5,755,041 A * 5/1998 Horwitz ..... 34/491
5,765,509 A * 6/1998 Liebig et al. ..... 122/7 R
5,770,823 A 6/1998 Piroozmandi
5,776,413 A * 7/1998 Kamberger et al. ..... 422/7
5,851,404 A * 12/1998 Christy et al. ..... 210/723
5,887,456 A * 3/1999 Tanigawa et al. ..... 68/20
5,993,512 A * 11/1999 Pargeter et al. ..... 75/416
6,058,623 A * 5/2000 Brooks et al. ..... 34/362
6,092,301 A * 7/2000 Komanowsky ..... 34/263
6,256,978 B1 * 7/2001 Gericke et al. ..... 60/39.182
6,343,570 B1 * 2/2002 Schmid et al. ..... 122/7 R
6,391,192 B1 * 5/2002 Haag ..... 210/96.1
6,406,510 B1 * 6/2002 Burnham ..... 71/11
6,478,461 B1 * 11/2002 Frank ..... 366/25
6,558,550 B1 * 5/2003 Kelly ..... 210/609
6,776,914 B2 * 8/2004 Hickey ..... 210/709
6,808,636 B2 * 10/2004 Ward et al. ..... 210/710
6,841,515 B2 * 1/2005 Burnham ..... 504/102
6,845,290 B1 * 1/2005 Wunderlin et al. ..... 700/208
6,868,621 B1 * 3/2005 Grimm et al. ..... 34/92
6,913,671 B2 7/2005 Bolton et al.
7,013,578 B2 * 3/2006 Wunderlin et al. ..... 34/528
7,024,795 B2 * 4/2006 Tadano et al. ..... 34/76
7,055,262 B2 * 6/2006 Goldberg et al. ..... 34/86
7,070,693 B2 * 7/2006 Kelly ..... 210/609
7,310,892 B1 * 12/2007 Cate et al. ..... 34/408
7,416,644 B2 * 8/2008 Bonde ..... 203/14
7,478,486 B2 * 1/2009 Wunderlin et al. ..... 34/491
7,491,861 B2 * 2/2009 Mason ..... 588/320
7,553,410 B1 * 6/2009 Chennault ..... 210/150
7,662,281 B1 * 2/2010 Longo ..... 210/198.1
7,665,225 B2 * 2/2010 Goldberg et al. ..... 34/73
7,665,227 B2 * 2/2010 Wright et al. ..... 34/339
7,669,348 B2 * 3/2010 Christy et al. ..... 34/361
7,763,219 B2 * 7/2010 Mason ..... 422/198
2004/0024279 A1 * 2/2004 Mason ..... 588/226
2004/0200093 A1 * 10/2004 Wunderlin et al. ..... 34/606
2005/0044744 A1 * 3/2005 Tadano et al. ..... 34/596
2005/0066538 A1 * 3/2005 Goldberg et al. ..... 34/218
2006/0179676 A1 * 8/2006 Goldberg et al. ..... 34/77
2006/0191161 A1 * 8/2006 Wunderlin et al. ..... 34/562
2006/0218812 A1 * 10/2006 Brown ..... 34/86
2008/0039674 A1 * 2/2008 Mason ..... 588/321
2008/0083133 A1 * 4/2008 Christy et al. ..... 34/378
2008/0083675 A1 * 4/2008 Christy et al. ..... 210/766
2008/0217324 A1 * 9/2008 Abbott ..... 219/538
2009/0000139 A1 * 1/2009 Hodges ..... 34/86
2009/0071033 A1 * 3/2009 Ahn et al. ..... 34/595
2009/0255142 A1 * 10/2009 Brown ..... 34/79
2010/0000112 A1 * 1/2010 Carow et al. ..... 34/357
2010/0089024 A1 * 4/2010 Bruckner et al. ..... 60/39.182
2010/0115785 A1 * 5/2010 Ben-Shmuel et al. ..... 34/260
2010/0146972 A1 * 6/2010 Sorita et al. ..... 60/653
2010/0243771 A1 * 9/2010 McKee ..... 241/23
2011/0030431 A1 * 2/2011 Peltier et al. ..... 71/12
2011/0041562 A1 * 2/2011 Balinski et al. ..... 68/20

FOREIGN PATENT DOCUMENTS

EP 549861 A2 * 7/1993
EP 599115 A1 * 6/1994
EP 633047 A1 * 1/1995
EP 2037034 A2 * 3/2009
GB 186701930 A * 12/1867
GB 2036276 A * 6/1980
GB 2163893 A * 3/1986
JP 54086475 A * 7/1979
JP 54104648 A * 8/1979
JP 54117394 A * 9/1979
JP 54117899 A * 9/1979
JP 55008574 A * 1/1980
JP 55008862 A * 1/1980
JP 55032938 A * 3/1980
WO WO 9403406 A1 * 2/1994
WO WO 9526556 A1 * 10/1995
WO WO 9957421 A1 * 11/1999
WO WO 03024559 A1 * 3/2003
WO WO 2008045857 A2 * 4/2008

* cited by examiner

HF
D

APPARATUS, METHOD AND SYSTEM FOR TREATING SEWAGE SLUDGE

CROSS-REFERENCE TO RELATED APPLICATIONS

This is a continuation-in-part of application Ser. No. 11/539,903, filed Oct. 10, 2006, the complete disclosure of which is herein incorporated by reference.

BACKGROUND OF THE INVENTION

It is known in the art of processing sewage sludge to render the sludge safe and sanitary, by various techniques, a number of which have been approved by the Environmental Protection Agency (EPA), which agency has developed regulations for proper treatment and disposal of sewage sludge.

The goal of treating sewage sludge is to neutralize pathogens to an environmentally safe level and to reduce vector attractiveness; i.e., to make the sewage sludge unattractive to rats, mice, flies, because these vectors can transmit the pathogens to humans and animals.

Various apparatus and methods for killing pathogens and reducing vector attractiveness have been developed, some of which are set forth in U.S. Pat. Nos. 5,013,458; 5,229,011; 5,186,840; 5,405,536; 5,433,844; 5,554,279; and 5,681,481, the complete disclosures of all of which are herein incorporated by reference.

Previous developments in the treatment of sewage sludge have sought to inexpensively stabilize the sludge through lime addition. These systems sometimes produced objectionable odors, dust and steam which producing an end product that was of a pasty consistency and therefore difficult to handle, often requiring specialized spreading equipment, for spreading the resultant treated waste on land. Additionally, in accordance with some existing systems, the objectionable odors, particularly ammonia, are, in part, a function of the heated sewage sludge.

In accordance with the existing developed technology, drying apparatus of various forms have been used to stabilize sewage sludge and produce a granular end product that appeared to be satisfactory, but was so extremely dry, for example in excess of 90% dry solids, such that the end product was often dusty and difficult to handle, because such processes and equipment lacked the ability to determine the solids concentration with a degree of precision, in that they simply evaporated water until the product became very dry.

Furthermore, some existing processes and equipment tend to operate on a batch basis, in which the treatment container would be filled, and the treated material then drawn off, out of the container. Typically, the container would be loaded until it became essentially full, and then rotors within the container, which would be fully submerged in the material operated to mix or tumble the material such that heat from the heated rotors would come in contact with the material. However, as moisture became drawn off by the heat applied, generally from the rotors within the container, the volume of the material being processed in the batch became reduced, with a result that less of the rotors came in contact with the material that was being processed. Because the efficiency of such an operation is in large part a function of the heated surface area that comes into contact with the material that is being processed, the result is that as the volume of material in the batch processing container is being reduced, the surface area that is in contact with the material being processed is likewise reduced, causing a corresponding reduction in the rate of evaporation of the liquid, principally water, that is a component of the sludge that is being processed.

Additionally, current apparatus and processes that are in use often estimate the moisture content of the final product in an indirect manner, using indirect measurements or timers. Consequently, the material being processed is dried until the temperature of the medium providing the heat increases substantially, providing an indication that all of the moisture has been removed from the product. Thus, in such processes and equipment, the processing of the batch is then considered to be complete, although it can be extremely dry and difficult to handle.

SUMMARY OF THE INVENTION

The present invention provides an apparatus, process and system for thermal stabilization of sewage sludge, with moisture reduction, to produce an end product having a solids concentration that is predetermined, generally between 10% and 99% solids, with the option of lime treatment or treatment by other chemical additives.

Accordingly, it is an object of this invention to provide an apparatus, process and system for treating sewage sludge by heating and/or evaporating and/or other chemical treatment, such as lime addition or the like, in which the sludge is delivered into a treatment container where it is mixed or tumbled while heat is applied to the material being treated, and wherein moisture gases, principally water, is drawn off and evaporated, with the treated material then being discharged from the container, and wherein any of various techniques may be employed for treating the sludge based upon the rate of moisture evaporation from the sludge, such as by using one or more weight-responsive members (such as load cells) to determine the solids content of the material being treated at any given time, by measuring the difference in weight of material in the container before and after moisture is drawn off from the material, or by assuming a rate of evaporation based upon experience and then entering this assumed rate into a controlling computer program, or by measuring the rate of evaporation at start up of the equipment and then entering that rate into a controlling computer program, or by approximating the rate of evaporation based upon measuring the load on the drive and then measuring the load on the drive as it changes due to water evaporation from the sludge, and using the differential in load to control the addition of more sludge to the container.

It is another object of this invention to accomplish the above object, with or without the addition of lime or other treatment chemicals for treating material in the container.

It is another object of this invention to accomplish the above objects, wherein the treatment of the material can occur in a batch operation, a pulsed operation, or in a continuous operation.

It is a further object of this invention to accomplish the above objects, wherein the control of sewage sludge into the container and the discharge of treated material from the container, is done via a programmed computer.

It is another object of this invention to accomplish the above objects, wherein the weight-responsive member(s) include one or more load cells that support the container.

Other objects and advantages of the present invention will be readily apparent upon a reading of the following brief descriptions of the drawing figures, the detailed descriptions of the preferred embodiments and the appended claims.

BRIEF DESCRIPTIONS OF THE DRAWING FIGURES

FIG. 1 is an overall schematic view of an apparatus and process for practicing this invention, in which a container or drum D is shown for receiving dewatered sludge or cake from a conveyor or pump unit P, that in turn, receives sewage sludge from a sludge storage silo SS, and wherein heated fluid HF is provided to the drum D, with moisture being drawn off from the drum for delivery to a scrubber condenser SC. Lime L may be provided from a lime storage silo, or other chemicals CH added for delivery to the drum D. Various controls and control lines are operated via a programmed computer C, such that the treated sludge is discharged from the drum D to a discharge conveyor DC from which the processed sludge is discharged, at a predetermined desired solids content. The processed sludge is conveyed to storage by a conveyor which may be used to cool the product before the finished product is stored in a pile or in a bulk silo.

Figure 1:
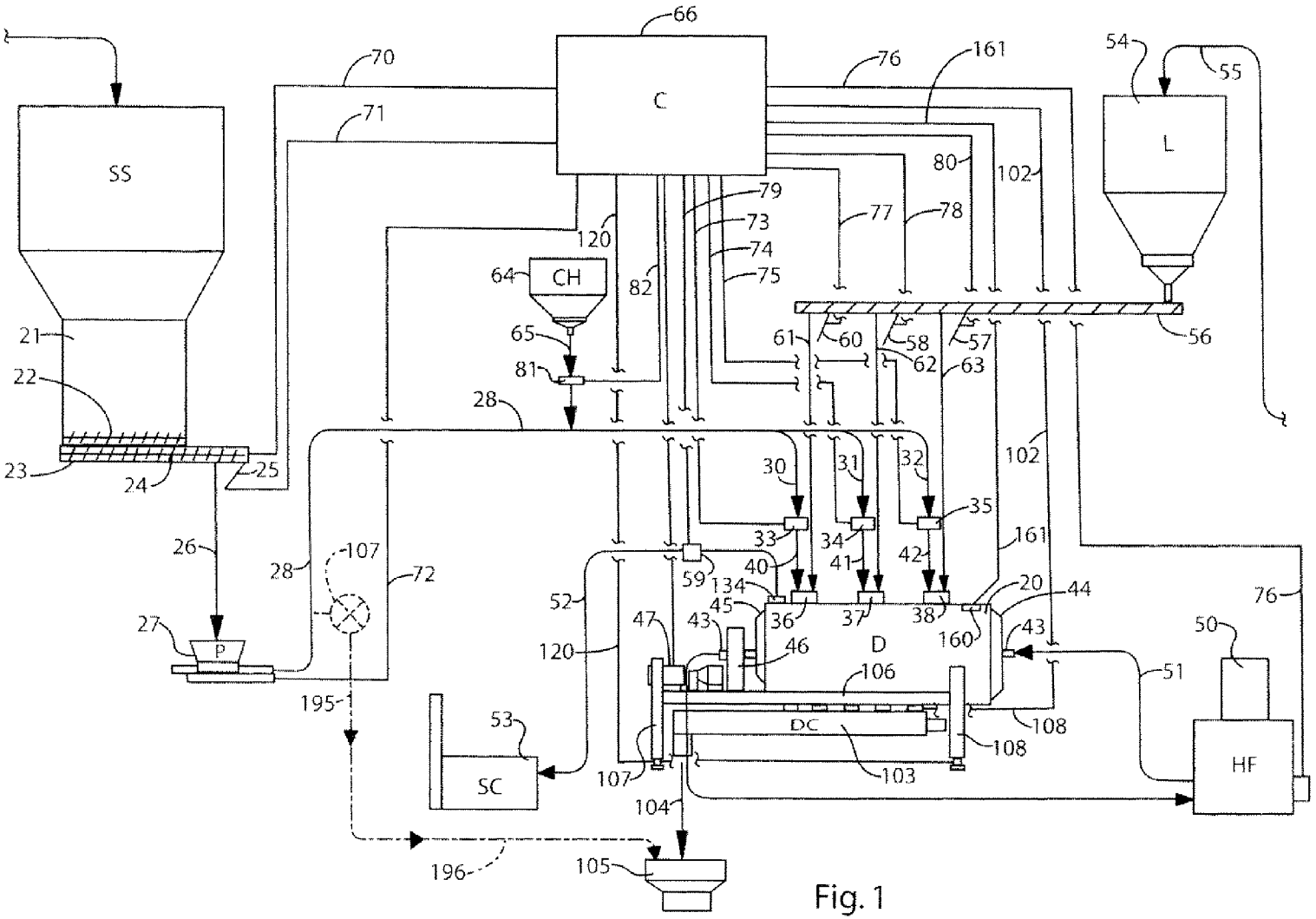
Figures 2, 2A, 2B, 2C:
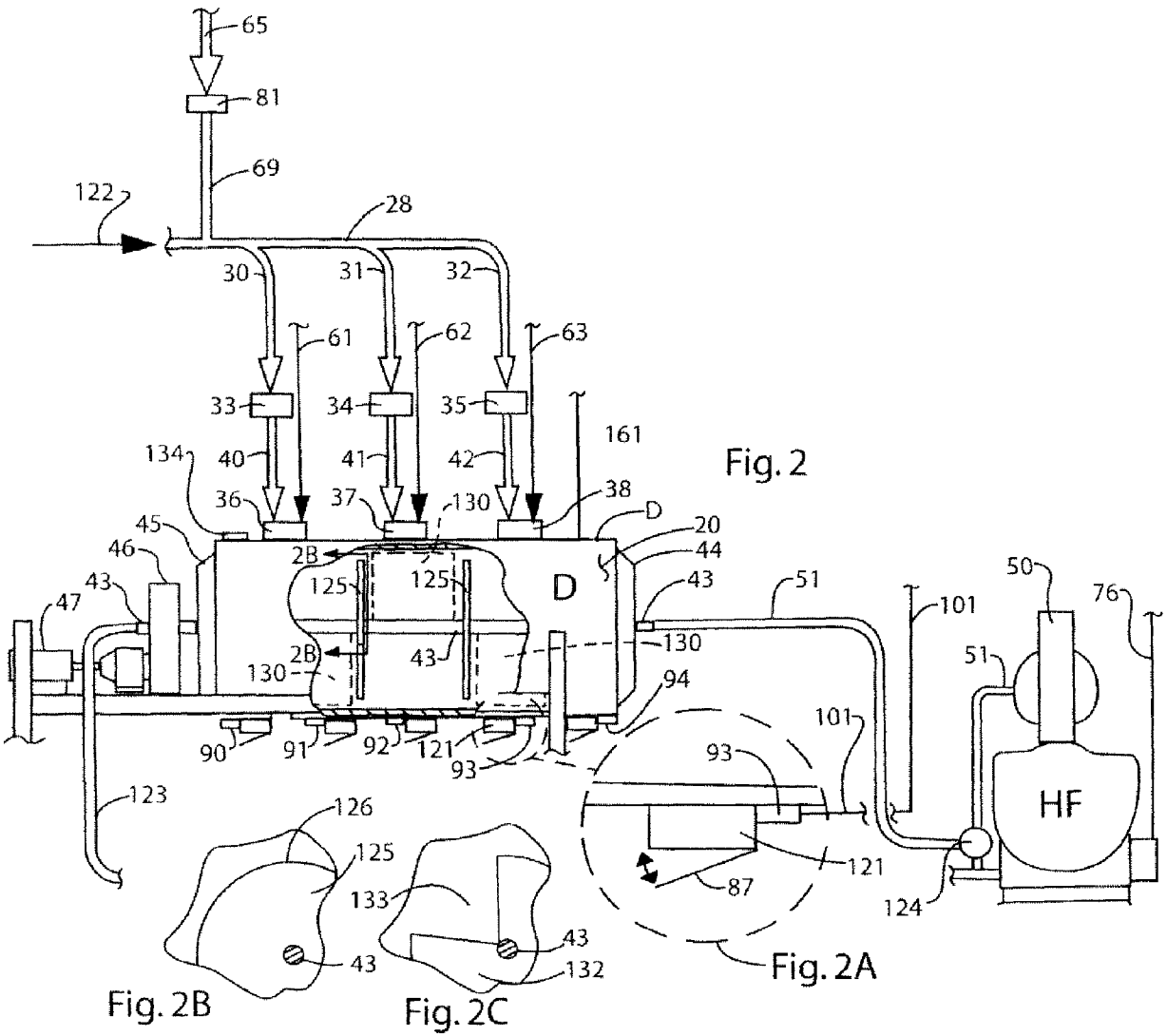
FIG. 2 is a partial schematic view of the drum D illustrated in FIG. 1, with a portion of the casing fragmentally broken away, to illustrate the internal components of the drum D.
FIG. 2A is an enlarged detail view of one of the openable discharge units for discharged treated product from the drum D.
FIG. 2B is a fragmentary transverse view of a portion of one of the rotatable disks from inside the drum D, taken along the line 2B-2B of FIG. 2.
FIG. 2C is an illustration to that of FIG. 2B, but wherein one of the rotatable disks are shown having an alternative configuration to the configuration of the rotatable disk illustrated in FIG. 2B.
Figure 3:
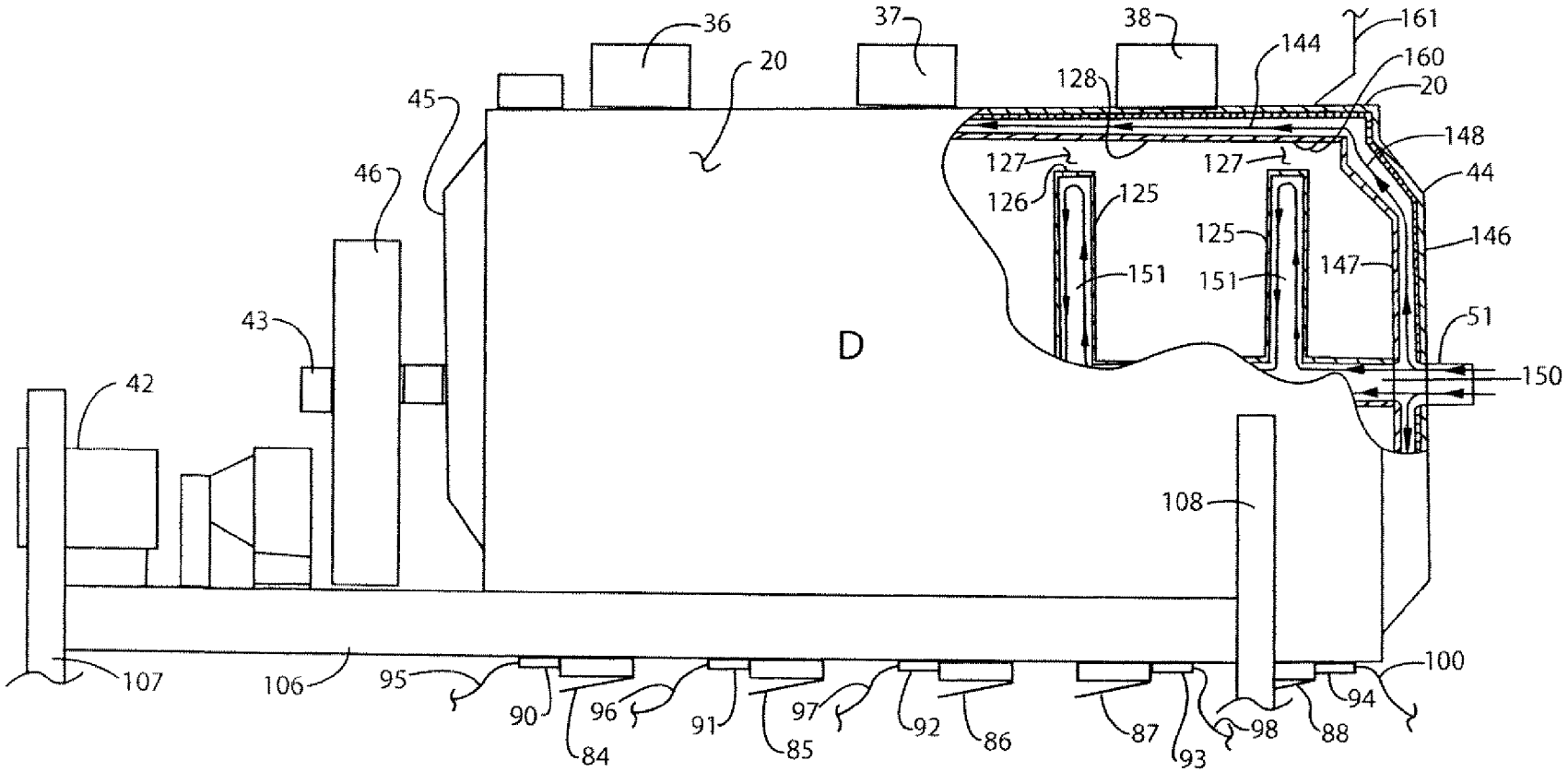

FIG. 3 is an enlarged illustration of the drum D to that illustrated in FIGS. 1 and 2, and wherein a portion of the casing of the drum is shown broken away, for clarity of illustration of the means for providing heated fluid to rotatable disks inside the drum, and between internal and external walls of the drum D, with the discharge units for discharging treated sludge from the bottom of the drum D, being more clearly illustrated.

Figures 4, 4A, 4B:
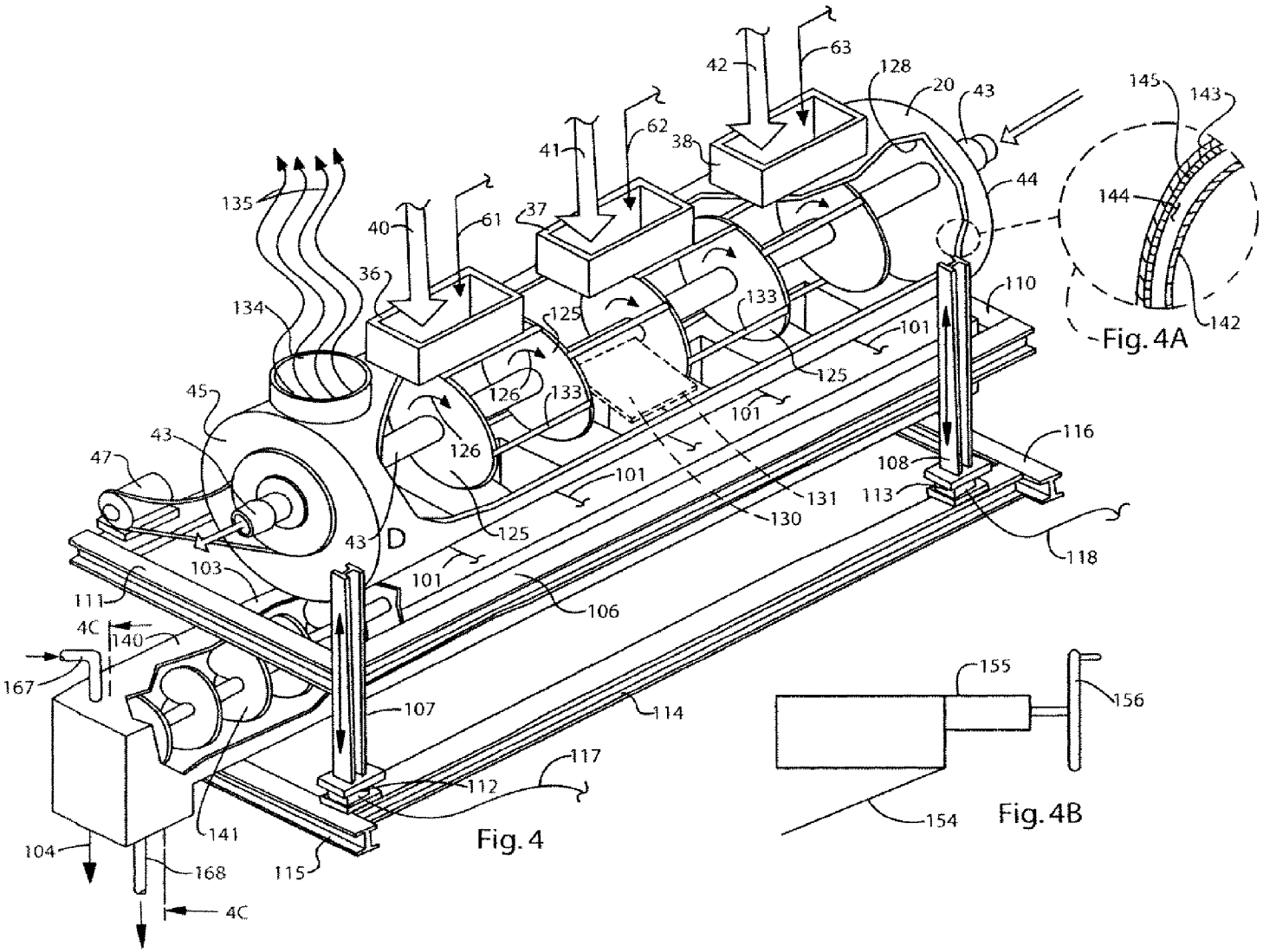

FIG. 4 is an enlarged perspective view of the drum D, with the casing being shown broken away, to better illustrate the rotatable shaft and disks within the drum, and with delivery ducts for delivering sludge to be treated into the drum D also being illustrated, and with a discharge conveyor DC also being illustrated beneath the drum D, for receiving treated sludge therefrom, and with the drum and its frame being illustrated, supported on load cells for weight measurement.

FIG. 4A is an enlarged detail view of a cross-section of the casing for the drum, showing a channel for heated fluid therein in enlarged cross-section.

FIG. 4B is an illustration of a discharge gate for discharging processed sludge from the drum D, at the bottom thereof, but wherein the control for operating the discharge gate of FIG. 4B is an alternative embodiment to that of FIGS. 1, 2 and 3, being comprised of a manual or automatic control apparatus.

Figure 4C:
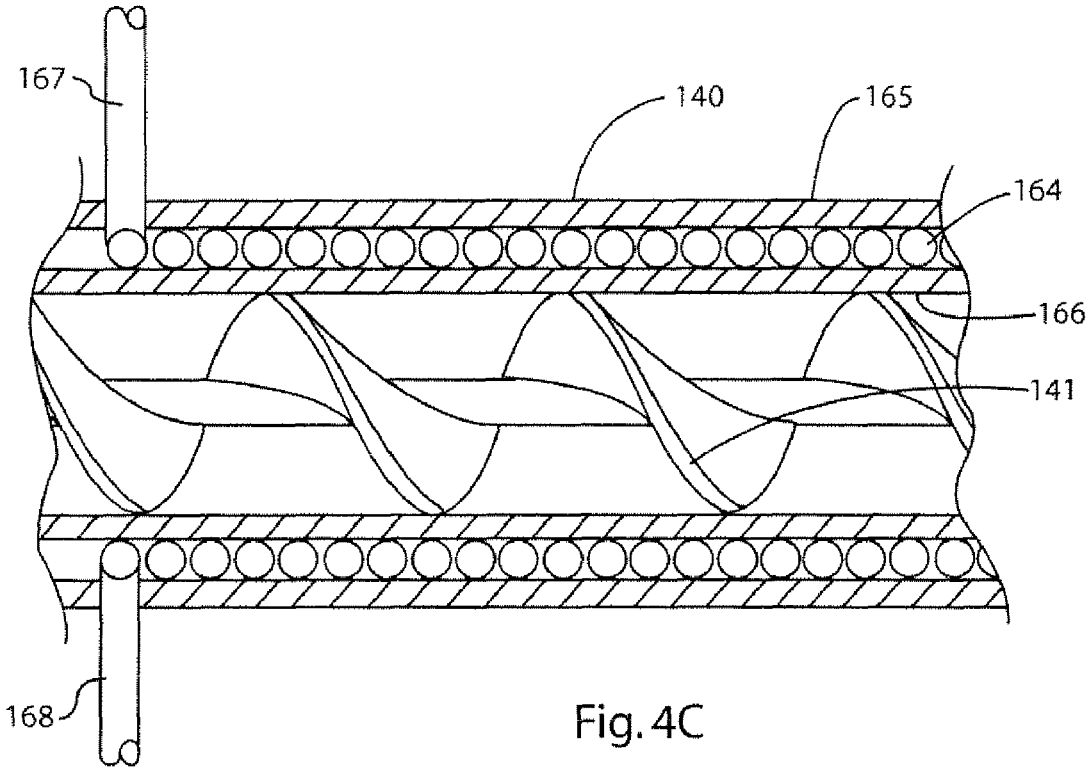

FIG. 4C is an enlarged fragmentary, longitudinal sectional view, taken through the left end of the treated sludge take-off conveyor, with the illustration of FIG. 4C being taken generally along the line 4C-4C of FIG. 4.

Figure 5C:
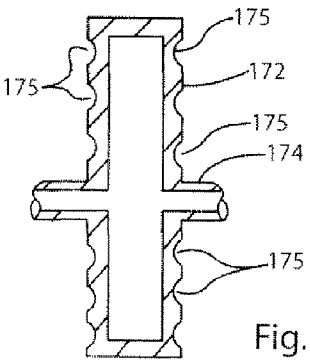
Figure 5:
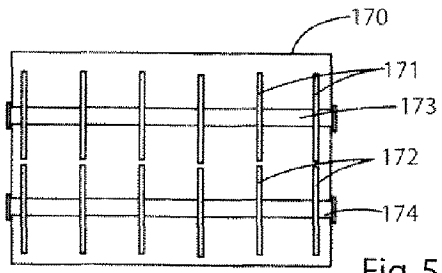

FIG. 5 is a schematic view of the inside of an alternative drum, having an arrangement of multiple mixing devices therein for moving the sludge within the drum, for mixing the sludge therein, with mixing devices rotating clockwise and/or counterclockwise.

Figure 5A:
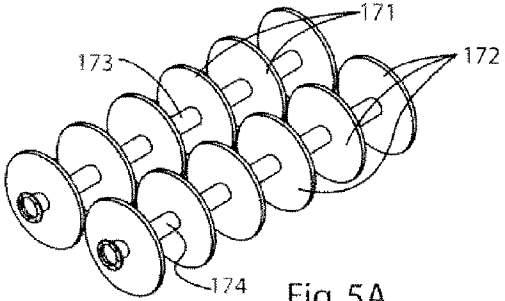

FIG. 5A is a schematic perspective view of the arrangement of multiple mixing devices illustrated in FIG. 5.

Figure 5B:
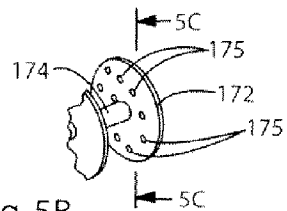

FIG. 5B is a fragmentary perspective view of a further embodiment of this invention in which the surfaces of the disc mixing devices that engage the sludge that is being mixed are "dimpled", having small round recesses therein, providing small pockets on the surfaces of the mixing devices that facilitate them sliding more easily through the sludge.

FIG. 5C is an enlarged fragmentary cross-section, through one of the mixing devices in which the opposite surfaces thereof are likewise dimpled, illustrating that both surfaces thereof can be dimpled; not just one surface.

Figure 6:
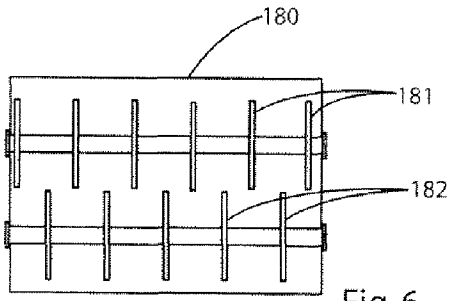

FIG. 6 is an illustration similar to that of FIG. 5, but wherein an alternative mixing device arrangement therein is illustrated.

Figure 6A:
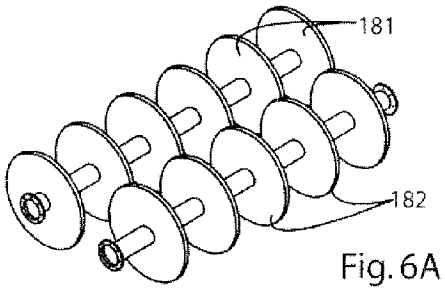

FIG. 6A is an illustration like that of FIG. 5A, but wherein the alternative mixing device configuration of FIG. 6 is shown in perspective.

Figure 7:
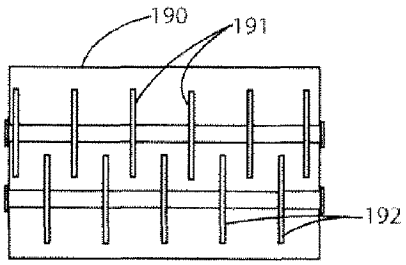

FIG. 7 is another alternative schematic illustration of a drum having a different mixing device arrangement than that illustrated in FIGS. 5 and 6.

Figure 7A:
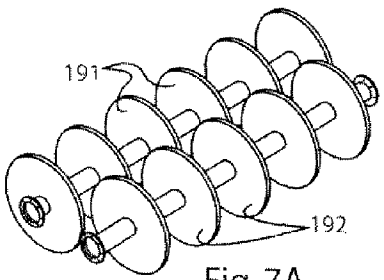

FIG. 7A is a perspective view of the mixing devices, somewhat similar to those of FIGS. 5A and 6A, but wherein an alternative configuration of FIG. 7 is illustrated for the mixing devices, in FIG. 7A.

DETAILED DESCRIPTIONS OF THE PREFERRED EMBODIMENTS

Referring now to the invention in detail, reference is first made to FIG. 1, wherein there is illustrated the drum 20, also identified by the letter "D" which functions as an evaporator of liquids, essentially water in the form of moisture.

The untreated sewage sludge is delivered from the sludge storage silo 21, also identified as "SS" in FIG. 1, via conveyors or a pump with the silo having a conveyor generally designated by the numeral 22 at the bottom thereof, for delivering the untreated sewage sludge into a further cylindrical dewatering conveyor generally designated by the numeral 23, having an auger 24 therein for discharging the sewage sludge via a discharge gate 25, in the direction of the arrow 26 therefrom, into a cake pump apparatus 27, also indicated by the letter "P", from which it is pumped via delivery line 28 and its sub-delivery lines 30, 31 and 32, through respective controlled valves 33, 34 and 35, and then through entry openings 36, 37 and 38, into the drum 20, via respective delivery lines 40, 41 and 42.

The drum 20 is generally cylindrical and is horizontally situated as shown in FIG. 1, to have a horizontally disposed rotatable shaft 43 extending from the right end 44 thereof. The shaft 43 extends through the drum 44, and outwardly of the left end 45 thereof, driven via a drive pulley or gear 46, that, in turn, is driven by a motor 47, as shown.

Heated fluid (HF) is provided via a thermal fluid heater 50, delivering the heated fluid via line 51 to the interior of the rotatable shaft 43, as will be further described hereinafter. The heated fluid, preferably oil, will provide heat within the drum 20, for heating the sewage sludge that is disposed therein, for the driving off of moisture, generally water, therefrom, as the moisture, evaporates from the sewage sludge. Such moisture, thus leaves the drum 20 via line 52, to be delivered to a scrubber/condenser 53, also identified as "SC" in FIG. 1. The rate of withdrawal of the air may be varied to optimize moisture removal without excessive loss of heat.

If, as part of the treatment process for the sewage sludge, it is desired to add lime in some form, such may be provided from a lime storage silo, also identified as "L" in FIG. 1, which periodically may have lime delivered thereto via line 55 from a lime delivery truck, or the like.

Also, when it is desired to add lime to the sludge for raising the pH of the sewage sludge, the lime may be delivered from the storage silo 54, through the bottom thereof, via a discharge auger 56, having a plurality of discharge gates 57, 58 and 60 at the bottom thereof, for discharging lime via lines 61, 62 and 63 respectively, into the drum 20, via drum inlets 36, 37 and 38, respectively.

Also, if other chemicals are desired to be added to the sewage sludge, for treatment thereby, such may be provided from chemical hopper 64, also identified as "CH" in FIG. 1, to be discharged therefrom via line 65, into the drum 20 via line 28, or in any other delivery manner, preferably to enter the drum 20 via inlets 36, 37 and 38.

The entire operation can be controlled from a programmed computer 66, also identified in FIG. 1 as "C". The computer 66 can control the operation of the sewage sludge discharge conveyor 23 via control line 70, the opening of sewage sludge delivery gates 25 via line 71, the operation of the cake pump 27 via control line 72, the operation of sewage sludge delivery valves 33, 34 and 35, the operation of valve control lines 73, 74 and 75, for sludge delivery valves 33, 34, 35, respectively, as well as many other functions that will hereinafter be described.

The control of the amount and temperature of thermal fluid delivered via thermal fluid heater 450, va line 51, to the drum 20, can likewise be controlled by the computer 66, via control line 76.

The optional delivery of the lime via the lime storage silo 54, when it is desired to increase the pH of the sewage sludge, for vector control or the like, the drum 20 can be controlled from the programmed computer 66 via gate control lines 77, 78 and 80, which respectively control the gates 60, 58 and 58 for discharge of lime from conveyor 56 into the respective inlets 36, 37 and 38 of drum 20, as shown in FIG. 1.

In the event that it is desired to add additional chemicals into the drum 20 for further treatment of sewage sludge, chemicals can be delivered from hopper 64 via line 65 and delivery line 28, by opening or closing a control valve 81, that, in turn, is controlled via line 82, also connected to the programmed computer 66.

Discharge from the drum 20, of dried sludge, with or without other components such as lime or other chemicals, is controlled via the operation of material discharge gates 84, 85, 86, 87 and 88, as are more clearly shown in FIG. 3, which discharge gates are, in turn, controlled by suitable solenoids or other control mechanisms 90, 91, 92, 93, and 94, respectively, which, in turn, are controlled by control lines 95, 96, 97, 98 and 100, all of which are, in turn, controlled by control line 101 that is connected via control line 102 to the programmed computer 66.

Thus, the controlled discharge gates 84, 85, 86, 87 and 88 allow for discharge of the treated sludge into a discharge conveyor 103, also identified by the letters "DC" in FIG. 1. Then, the discharge from the discharge conveyor can pass via line 104 into a further storage silo, truck or the like 105, either immediately, or after being handled by intermediate conveyor devices (not shown), as shown in FIG. 1.

The treatment drum 20 is mounted on horizontal and vertical frame members 106, 107, 108, 110 and 111, as shown in FIGS. 1 and 4. Generally, the horizontal frame members are supported by four vertical frame members, such as those 107 and 108, with two mounted on each side, (front and back) of the horizontal frame members, which carry the drum 20.

The vertical frame members 107 and 108, and their corresponding vertical frame members (not shown) at the rear of the drum 20 as shown in FIG. 1, are each mounted on weight-responsive members in the form of load cells 112 and 113, that, in turn, may be mounted on a floor, or, as shown in FIG. 4, may be mounted on other floor-mounted horizontal supports 114, 115, and 116. It has also been found, that it is highly desirable that the loads on the load cells be distributed relatively uniformly across all of the legs, in order to avoid an imbalanced load that can adversely affect the desired accuracy, in the event that the loads on the legs are imbalanced. Furthermore, by balancing the loads on the various load cells, the operator can know when the desired weight for the end product has been reached. Also, by balancing the loads on the several load cells greater accuracy is achieved. The load cells 112 and 113 are electrically connected via control lines 117 and 118, together, and to the programmed computer 66, via control line 120. The load cells may, if desired, by constructed in accordance with one or more of U.S. Pat. Nos. 5,770,823; 4,064,744; 4,166,997; 4,454,770; and 5,313,022, the complete disclosures of which are herein incorporated by reference.

With reference now to FIG. 2, it will be seen that chemicals may be added from the hopper 64 as shown in FIG. 1, via feed line 69, to the sludge feed line 28, in the direction of the arrow 122, to pass through valves 33, 34, and 35 via sub-feed lines 30, 31, and 32 respectively, to enter the drum 20 via inlet openings 36, 37 and 38 from feed lines 40, 41 and 42, as permitted by the programmed computer 66 which controls the valves 33, 34, and 35 via control lines 73, 74 and 75 as shown in FIG. 1.

Also, as shown in FIGS. 1 and 2, there is a hot oil return line 123, for returning hot oil from the drum 20 back to the thermal fluid heater 50, through a pump 124 thereof.

With reference to FIG. 2A, it will be seen that a typical discharge means 121 from each of the five discharges at the lower end of the drum 120 is shown in an enlarged detail view, for greater clarity.

With reference now to FIG. 2B, it will be seen that the rotatable shaft 43, disposed within the drum 20 carries generally plate-like cylindrical disks 125 mounted thereon, with the disks 125 being generally cylindrical, each having its outer periphery 126 spaced radially inwardly as shown at 127 in FIG. 3, from the inner cylindrical wall 128 of the drum 20, such spacing 127 preferably being approximately 3 inches or the like, to allow for free flow of sludge material and any other ingredients entering into the drum 20 via inlets 36, 37 and 38, axially throughout the drum 20 between the ends 44, 45 of the drum, across the clearance spaces 127 radially outwardly of the disks 125. Alternatively two or more rotating shafts with disks can be used to increase the capacity of the device.

With reference to FIG. 2, it will also be seen that the rotatable shaft 43 has mounted thereon a plurality of preferably planar plates 130, shown in phantom in FIG. 2. The plates 130, as is more clearly shown in FIG. 4 are adapted to rotate with the shaft 43, and each have an outermost edge 131 that is in close, but slightly spaced relation to the inner cylindrical wall 128 of the drum 120, for scraping sludge that is being treated from the inner cylindrical wall 128, to avoid sludge build-up thereon.

The plates 130 thereby operate as a pusher means, for pushing material being treated, in a circular direction, as the shaft 43 rotates, clockwise and/or counterclockwise.

With reference now to FIG. 2C, an alterative configuration for the shaft-mounted plates are provided, each in the form of a segment of a disk 132, having a notch-out 133 therein, with the disk 132 being otherwise similarly constructed to the construction of the disk 125 of FIG. 2B. The notch-out 133 allows for additional possibilities for axial flow of material being processed throughout the drum 20, in addition to the axial flow permitted by material passing axially throughout the drum 20 via the radial spaces 127 between the peripheries 126 of the disks 125, inward of the cylindrical inner wall 128 of the drum 20.

With reference to FIG. 4, it will be seen that, between the rotatable disks, in addition to or instead of the plate-like agitator means 130, there are provided rods 133 carried between and by the disks 125, for rotation therewith, as the disks 125 rotate in the direction of the arrows 126 shown therein, to additionally act as a agitator means, for mixing sludge material with or without other ingredients, and tumbling or mixing the same within the drum 20.

At the upper left end of FIG. 4, there is shown an exhaust duct 134, for carrying off gases in the form of moisture, with or without dust or the like, via representative discharge lines 135, illustrated, to represent moisture being drawn off from liquid, principally water, being evaporated from sludge being processed within the drum 20. The moisture that is drawn off is provided via line 52, to the scrubber/condenser 53, illustrated in FIG. 1. The rate of removal may be varied by being controlled from the programmed computer 66 to control valve 59 in line 52, via control line 79, to maximize the removal of moisture while minimizing the loss of heat or BTUs.

Mounted beneath the drum 20 the discharge or take-off conveyor 103, extending axially therealong, as shown in FIG. 4, has openings at its upper end (now shown) for receipt of dried sludge being discharged from the drum 20 through controlled discharge gates 84, 85, 86, 87 and 88 as shown in FIG. 3, through openings in the top 140 of the discharge conveyor 103. Inside the discharge conveyor, is a generally helically disposed auger, shaft-mounted as shown at the left end of FIG. 4, for axial conveyance of treated sludge therealong, to be discharged therefrom, as shown via discharge line 104 as described above with respect to FIG. 1.

With reference now to FIG. 4A, an enlarged cross-sectional detail of the cylindrical wall of the drum 20 is shown, as including an inner wall 142 and an outer wall 143 spaced therefrom, defining a generally cylindrical space 144 therebetween. Optionally, a layer of insulation 145 may be provided at, or as part of the outer wall 143, to preserve heat within the drum 20.

With reference to FIGS. 4A and 3, it will be seen that heated fluid, preferably oil, provided from the thermal fluid heater 50 is provided via line 51, between hollow end wall portions 146 and 147, to enter into the cylindrical zone 144 described above, in the direction of the arrow 148. Simultaneously, heated oil passes through the rotating shaft 150, to enter into the interiors 151 of the disks, to heat the exterior surfaces of the disks, which will then engage sludge that is being processed therein, to transfer heat to the sludge, for evaporation of moisture therefrom, drying the sludge, with the moisture then passing out through the exhaust port 134 of the drum 20, and to the scrubber/condenser 53, via line 52, as described above.

In FIG. 4B, there is shown an alternative embodiment for the gates 84, 85, 86, 87 and 88 of FIG. 3, in the form of discharge gate 154 having a solenoid or other control 155, which is operated by a hand crank 156 or the like, for manually opening the gates 154, instead of the manner described above with respect to the gates of FIGS. 1-3, which are controlled by the programmed computer 66.

A plurality of temperature sensors 160 may be present in the drum 20, for sensing the temperature at various locations therein, as the sewage sludge is being mixed or tumbled, and delivering that information via control line 161 to the computer 66, for determining if the desired temperature, for example 72° C. is reached for a desired period of time, for example at least 20 minutes, for providing information about the rate of evaporation of moisture, generally water, from the sewage sludge being treated.

With reference now to FIG. 4C, as taken at the left end of the take-off auger conveyor 140, it will be seen that a cooling means is provided for the take-off conveyor 140, for cooling treated sludge in the take-off conveyor 140. The cooling means can be of any type, but may, for example, be in the form of a continuous, spiral wound tubing 164, between outer and inner walls 165, 166 of the take-off conveyor 140, with suitable water feed and discharge lines 167 and 168, respectively, for cooling the treated sewage sludge that has been discharged from the drum 20, as it is passed through the take-off conveyor 140 by means of the shaft-mounted helical auger.

With reference now to FIGS. 5, 5A, 5B, 5C, 6, 6A, 7 and 7A, it will be seen that alternative arrangements for the drum 20 of FIG. 1 are shown. Specifically, with reference to FIG. 5, it will be seen that a drum 170 is illustrated having a parallel pair of mixing devices comprising spaced-apart hollow discs 171 and 172 similar to the discs 125 of FIG. 3 being rotatably driven therein.

The discs 171 and 172 are mounted on respective hollow rotatable shafts 173 and 174, in much the same manner as the rotatable discs 125 are shaft-mounted at 43 as shown in FIGS. 2 and 3.

As shown in FIGS. 5B and 5C, the surfaces of the discs 171 and 172 have "dimpled" recesses 175 therein for providing less resistance to the sludge through which the discs are moving, so that the discs slide more easily through the sludge, producing greater efficiency.

It will be understood that these dimpled surfaces for the discs apply equally to the discs of FIGS. 5, 5A, 6, 6A, 7 and 7A, and such description need not be duplicated herein.

With reference to FIGS. 6 and 6A, it will be seen that an alternative drum 180 is provided, to that 170 of FIG. 5, and wherein the shaft-mounted discs 181 and 182 are interleaved, but spaced apart as shown in FIGS. 6 and 6A. With reference to FIGS. 7 and 7A, the drum 190 is provided with shaft-mounted discs 191 and 192, but wherein the discs are interleaved with each other as shown in FIGS. 7 and 7A, but not spaced apart, so that a given disc 192 is partially disposed between discs 191, as shown in FIGS. 7 and 7A.

Operation

In operation, the sewage sludge that is stored int eh silo 21 is withdrawn therefrom by means of the generally helical conveyor 22 at the bottom thereof, and enters into a preferably dewatering conveyor 23, also preferably having a generally helical auger therein, for discharging sewage sludge therefrom, via the discharge gate 25, with the sludge then being delivered via line 26 to the cake pump apparatus 27, from which it is pumped via line 28 and its sub-delivery lines 30, 31 and 32, through valves 33, 34 and 35 that are operated by the computer 66, to deliver the sewage sludge into the drum 20, through entry openings 36, 37 and 38. If lime treatment is desired, lime can be provided from a storage bin 54 that has been supplied from a truck or the like via line 55, with the lime then being discharged via an auger type conveyor 56, through gates 57, 58 and 60, to be provided into the drum via lines 61, 62 and 63.

If additional or different chemicals are desired to be added to the sewage sludge for treatment, then can be provided from a chemical hopper 64 via line 65, into sludge intake line 28, or, alternatively, directly into the drum 20 (not shown).

As with the cake pump 27 that has a control line 28, and as with the gate 25 having a control line 71, and as the valves 33, 34 and 35 are controlled via lines 73, 74 and 75, respectively, from the computer 66, so is the valve 81 controlled via line 82 from the computer 66.

A heat medium, preferably heated oil, is provided from a thermal fluid heater 50, via linen 51, into the center of the shaft 43 of the drum 20, with the heated oil heating the hollow center of the shaft 51 within the drum 20, as well as heating the interiors 151 of the disks 125, in order to maximize the surface area of the heated portions of the drum 20, to maximize the opportunity for sewage sludge containing either no additional materials, or containing lime or other chemicals, for maximum contact with heated surfaces, to facilitate and maximize the evaporation of moisture therefrom.

When sludge is delivered into the drum 20 via inlets 36, 37, and 38, it has an opportunity to pass axially, or longitudinally through various portions of the drum, because of the spacing 127 between the outer peripheries of the disks 125 and the inner cylindrical surface 128 of the drum.

Also, within the drum 20, pusher means in the form of the plates 130 described above and/or the rods 133, facilitate tumbling and pushing and otherwise mixing in the sewage sludge within the drum 20. Furthermore, the generally radially disposed plates 130 facilitate the prevention of accumulation of sewage sludge on the inner surface of the cylindrical wall 128 of the drum, because such run in close clearance to the inner surface 128.

One or more sensors 160 can sense the temperature of sewage sludge within the drum 20 and communicate the same via line 161, back to the computer 66 to signal to the computer the temperature of the sludge at any given time, or when the sludge temperature has reached a desired predetermined level.

As moisture is evaporated from the sludge within the drum, such is drawn off via discharge vent 134, through line 52, to the scrubber/condenser 53, which will neutralize fumes, dust and the like that is drawn off from the drum 20 during the treatment of the sludge.

The drum 20, is mounted on a plurality of weight-responsive members 112, 113 (preferably comprising four such members), which weight-responsive members are preferably load cells. The load cells communicate the weight of the drum and its framing structure, including the weight of sludge entering the drum before and after water is removed, and in fact, such load cells communicate changes in weight on a continuous basis, back to the computer 66.

When a predetermined desired solids level is reached within the drum 20, the computer 66 signals the opening of discharge gates 84, 85, 86, 87 and 88 for the discharge of treated sludge from the drum 20, into the take-off conveyor 103, through the top 140 thereof, where the dried sludge is delivered through the cooled discharge conveyor, which can be cooled in the manner set forth in FIG. 4C, with the helical screw auger 141 delivering the dried and treated sludge material from the left-most end of the discharge conveyor 103, as shown at 104, into a storage silo or the like, or even a truck for carrying the same away, as shown at 105.

As an alternative to the computer control, if manual operation is desired, such can be done via manual control of discharge gates 14, via a manually operated hand crank 156, or the like.

It will also be apparent that in accordance with this invention, it is possible to run in a bypass mode, whereby the pump 27 shown in FIG. 1 can alternatively deliver cake via lines 195, 196, directly to storage at 105, upon the opening of a valve 107 such that cake is bypassed via line 195, rather than proceeding along delivery line 28, during which the treatment in the drum 20 can be avoided.

When lime is added from lime storage silo 54, as described above, a Class B level of stabilization can be achieved, which, while producing more end product for storage at 105, or for delivery to a disposal site, provides an additional level of flexibility in the use of the equipment.

Thus, in accordance with the present invention, the process described herein effectively stabilizes sewage sludge by greatly reducing disease-carrying pathogens and minimizes the potential for transmission of pathogens by reducing the potential for vectors to be attracted to the finished product. The end product can be further conditioned to reduce the moisture content, in effect reducing the volume of product that needs to be transported and disposed.

The process environment is essentially sealed to minimize undesirable emissions. The end product is thereby conditioned to further educe emissions and dusting, and is a product of relatively uniform size and consistency.

The cooling of the end product in the take-away conveyor 103, serves to minimize the release of both steam and ammonia and also results in a hardening of the finished product that enhances its friability and enables the sizing of the product to produce a product with nominal or no odors, of uniform size, and having a granular consistency.

The use of load cells or other weight-responsive members provides a means to measure weight gravimetrically, to monitor the weight of the contents of the drum so that through simple mathematical calculations, preferably performed by the computer, a predetermined solids concentration of the contents of the drum can be accurately and repeatedly produced.

The process can be practiced either in a batch operation, a pulsed operation, or in a continuous operation.

In a batch operation, the computer will control the delivery of sludge to be processed in the drum, and after a predetermined time, or when the heat sensors in the drum signal the computer to having reached a predetermined heat level, the gates at the bottom of the drum will be opened automatically as dictated by the computer, to discharge treated sludge to the take-away conveyor.

In a pulsed or semi-continuous mode, the system can be operated such that a predetermined amount of material is added to the drum and, subsequently, as the initial material is reduced in weigh through evaporation, as noted by the load cells or other weight-responsive means, the computer can signal the opening of appropriate valves for introduction of additional material into the drum.

Additionally, in a continuous operation, as the load cells repeatedly record the weight of material in the drum, and signal the computer accordingly, a rate of evaporation is established, enabling the computer to set a feed rate and operate the inlet valves that supply sewage sludge to the drum, at a continuous rate.

In a somewhat different embodiment of the invention, in which it would not be essential to use weight-responsive members for mounting the drum, one could monitor the rate of evaporation of moisture, either via the weight-responsive members 112, 113, or by measuring the moisture that is driven off via outlet 134, by a suitable measuring instrument either in line 52, or in the scrubber condenser 53, or by measuring the weight of such moisture delivered to the scrubber condenser 53, or by visually monitoring the level of material in the drum 20 at any given time, and then adding further material into the drum in amounts that are responsive to the rate of evaporation of moisture from the drum, as thus determined. The addition of material to the drum could be either in a pulsed or intermittent feed of material to the drum as the computer 66 would determine the opening of valves 33, 34 and/or 35 to deliver the sludge, chemicals or other material to the drum, or alternatively, the step of adding material to the drum could be substantially continuously done, by adding material to the drum in a substantially continuous manner, in amounts that substantially continuously keep the drum full.

The addition of material to the drum could be done by adding the material to the drum at a predetermined rate, either continuously, or intermittently. In the case of an intermittent delivery of material to the drum, such could be done via a pulsed feed of material to the drum. Similarly, if lime is to be some of the material that is delivered to the drum, such could be dine via the lime delivery conveyor 56, and by controlling the gates 57, 58 and 60 that allow the passage of lime therefrom, into the drum, via computer control or the like.

Thus there is presented a system for thermal stabilization of sewage sludge followed by additional moisture reduction that produces a predetermined end product concentration that can be between 10% and 99% solids. The system delivers a sludge cake to the drum, in which sewage sludge is thermally processed, with optional chemical treatment by lime or other chemicals. The resultant dried product, having a solids concentration that can be predetermined to be between 10% and 99% dry, is thereby produced. The gas scrubbing can eliminate or at least very substantially reduce noxious odors.

The system described herein stabilizes sludge in a virtually sealed environment, which helps to control offensive odors, withdrawn gasses and particulates while allowing the operator the flexibility to produce a friable end product that is more preferably between about 40% and 99% dry solids.

The system can also be manually operated, as described above.

If it is desired in operating the system to produce a finished product having a concentration for example between 75% and 99% dry solids, the sewage sludge will be retained within the drum or thermal reactor for a period of time, adding heat until the final product's solids concentration reaches the predetermined desired concentration.

When it is desired to also treat the sewage sludge with lime, sufficient lime is added to raise the pH of the sewage sludge to about 12.0 for a predetermined period of time, to further reduce vector attractiveness, and enhance the stability of the finished product, even at a lower solids concentration than that described above.

To the extent that the addition of heat and chemicals may result in the generation of gasses and particulates, such can be removed by the scrubber 53.

Thus, an apparatus, process and system is provided for stabilizing sewage sludge, wherein an inventory of sludge is accumulated at some known or estimated solids concentration, prior to being fed into the evaporator drum. The sewage sludge is thus initially fed into the reactor drum, heat is applied and as moisture is removed, additional sewage sludge is then added to the drum. After stabilization has been completed, additional conditioning may be accomplished through further moisture reduction, cooling, size reduction and eventually the conveying of the solids to storage. The off gasses are conditioned to remove any objectionable characteristics. The stabilization of the sewage sludge is thus achieved through thermal conditioning. The sludge is heated in the evaporator drum to or above a predetermined temperature, for a predetermined time, until a predetermined solids concentration between about 40% and 99% dry solids is achieved. Alternatively, the stabilization of the sewage sludge is achieved through the thermal conditioning to or above a predetermined temperature for a predetermined period of time and chemical(s) are added to stabilize the sewage sludge at lower solids concentrations.

The contents of the evaporator drum are monitored through the use of mathematical formulas, which may be further enhanced through data that is accumulated from the load cells or other gravimetric devices, to control the stabilization process or system.

In drawing off moisture, such can be done at a variable rate which maximizes the moisture removed, while not removing excessive heat (BTU's) or dust from the drum.

In accordance with this invention, the system provides an economical method of stabilizing sewage sludge that can be fully automatic, thus enabling the system to take advantage of off-peak energy rates and processing, which system can be operated in an unattended manner, thereby also reducing the costs of manpower.

It will be apparent from the foregoing that various modifications may be made in the apparatus described above, as well as in the process steps, as may suggest themselves to those skilled in the art, upon a reading of this specification, all within the spirit and scope of the present invention, as defined in the appended claims.

What is claimed is:

1. A method of treating sewage sludge by heating and/or evaporating and/or pasteurizing and/or otherwise chemically treating material comprising sludge and any added ingredients comprising:

(a) providing a drum;
(b) delivering the material to the drum;
(c) tumbling the material within the drum;
(d) heating the material in the drum;
(e) drawing off moisture gases being evaporated from the material in the drum;
(f) discharging the material from the drum via a discharge outlet;
(g) ascertaining the rate of evaporation of moisture from the drum; and
(h) adding material into the drum in amounts responsive to the rate of evaporation of moisture from the drum.

2. The method of claim 1, wherein the step of adding material to the drum includes a pulsed feed of material to the drum.

3. The method of claim 1, wherein the step of adding material to the drum includes continuously adding material to the drum in amounts that substantially keep the drum full.

4. The method of claim 3, wherein the material is added to the drum at a predetermined rate.

5. The method of claim 1, wherein the step of adding material to the drum includes intermittently adding material to the drum in amounts that substantially keep the drum full, in a pulsed feed of material to the drum.

6. The method of claim 1, wherein said moisture gases are drawn off via an exhaust line separate from said discharge outlet in a manner such that moisture removal is maximized while minimizing the loss of heat.

7. A method of treating sewage sludge by heating and/or evaporating and/or pasteurizing and/or otherwise chemically treating material comprising sludge and any added ingredients comprising:

(a) providing a drum;
(b) delivering sludge to the drum;
(c) tumbling the material within the drum via a drive mechanism;
(d) heating the material in the drum;
(e) drawing off moisture gases being evaporated from the material in the drum;
(f) discharging the treated material from the drum; and
(g) ascertaining the evaporation rate of moisture being drawn off during step (e) by any one of the techniques of:
  (i) providing at least one weight-responsive member on which the drum is mounted and measuring the difference in weight of material in the drum via the at least one weight responsive member, before and after moisture is drawn off from the material, prior to discharge of treated material from the drum, whereby the solids content of the treated material can be determined;

(ii) assuming an evaporation rate and entering that rate into a programmable computer for controlling subsequent drawing-off of moisture;

(iii) measuring the evaporation rate at start-up of the treatment process and entering that rate into a programmable computer for controlling subsequent drawing-off of moisture; and (iv) approximating a rate of evaporation by measuring the load on the drive mechanism for the drum and measuring the load on the drive mechanism for the drum thereafter as moisture is drawn off and delivering more sludge to the drum as a function of the changing load on the drive mechanism.

8. The method of claim 1 wherein the drum has an internal hollow, rotatable shaft; wherein the tumbling step of clause (c) includes rotating the shaft within in the drum; and wherein the heating step of clause (d) includes heating the material in the drum by delivering a heated fluid through the rotatable shaft.

9. The method of claim 8, wherein the step of adding material to the drum includes a pulsed feed of material to the drum.

10. The method of claim 8, wherein the step of adding material to the drum includes continuously adding material to the drum in amounts that substantially keep the drum full.

11. The method of claim 10, wherein the material is added to the drum at a predetermined rate.

12. The method of claim 8, wherein the step of adding material to the drum includes intermittently adding material to the drum in amounts that substantially keep the drum full, in a pulsed feed of material to the drum.

13. The method of claim 8, wherein said moisture gases are drawn off via an exhaust line separate from said discharge outlet in a manner such that moisture removal is maximized while minimizing the loss of heat.

14. The method of claim 1, including the step of varying the removal of air from the drum by controlling the amount of moisture gases being drawn off the material, to maximize the removal of moisture while minimizing the loss of heat.

15. The method of claim 8, including the step of varying the removal of air from the drum by controlling the amount of moisture gases being drawn off the material, to maximize the removal of moisture while minimizing the loss of heat.

* * * * *

UNITED STATES PATENT AND TRADEMARK OFFICE

CERTIFICATE OF CORRECTION

PATENT NO. : 8,065,815 B2
APPLICATION NO. : 11/867951
DATED : November 29, 2011
INVENTOR(S) : Richard W. Christy et al.

It is certified that error appears in the above-identified patent and that said Letters Patent is hereby corrected as shown below:

Column 5, line 28, reads "78 and 80, which respectively control the gates 60, 58 and 58"
should read -- 78 and 80, which respectively control the gates 60, 58 and 57 --

Column 7, line 23, reads "4, has openings at its upper end (now shown) for receipt of"
should read -- 4, has openings at its upper end (not shown) for receipt of --

Column 8, line 21, reads "In operation, the sewage sludge that is stored int eh silo 21"
should read -- In operation, the sewage sludge that is stored in the silo 21 --

Column 8, line 67, reads "thermal fluid heater 50, via linen 51, into the center of the"
should read -- thermal fluid heater 50, via line 51, into the center of the --

Column 10, line 11, reads "tioned to further educe emissions and dusting, and is a prod-"
should read -- tioned to further reduce emissions and dusting, and is a prod- --

Signed and Sealed this
Twenty-first Day of February, 2012

David J. Kappos

David J. Kappos
*Director of the United States Patent and Trademark Office*